United States Patent [19]

Hardin, Jr.

[11] 4,254,454

[45] Mar. 3, 1981

[54] SELF-VENTILATING DENTAL LIGHTING DEVICE

[75] Inventor: William C. Hardin, Jr., Charlotte, N.C.

[73] Assignee: Pelton & Crane Company, Charlotte, N.C.

[21] Appl. No.: 105,888

[22] Filed: Dec. 21, 1979

[51] Int. Cl.[3] ..... F21V 29/00

[52] U.S. Cl. ..... 362/282; 362/294; 362/345; 362/804

[58] Field of Search ..... 362/74, 218, 267, 345, 362/373, 804, 294, 282, 283, 284; 352/202; 353/57, 61

[56] References Cited

U.S. PATENT DOCUMENTS

| | | | |
|---|---|---|---|
| 1,680,139 | 8/1928 | Edelmann . | |
| 2,289,160 | 7/1942 | Yost . | |
| 3,107,863 | 10/1963 | Potapenko | 362/294 |
| 3,353,015 | 11/1967 | Franklin et al. . | |
| 3,375,366 | 3/1968 | Scheppe | 362/294 |
| 3,486,019 | 12/1969 | Bryant et al. . | |
| 3,573,452 | 4/1971 | Kenyon et al. | 362/294 |
| 3,588,488 | 6/1971 | Lauterbach . | |
| 3,593,019 | 7/1971 | Martinez . | |
| 3,654,453 | 4/1972 | Jablonski . | |
| 3,784,808 | 1/1974 | Mori . | |
| 3,883,732 | 5/1975 | Peterson et al. | 362/294 |
| 4,032,771 | 6/1977 | Iizig | 362/294 |
| 4,037,096 | 7/1977 | Brendgord et al. | 362/294 |
| 4,053,759 | 10/1977 | Wilkinson | 362/218 |

FOREIGN PATENT DOCUMENTS

| | | | |
|---|---|---|---|
| 503313 | 5/1954 | Canada | 362/804 |

*Primary Examiner*—L. T. Hix
*Assistant Examiner*—Alan Mathews
*Attorney, Agent, or Firm*—Bell, Seltzer, Park & Gibson

[57] ABSTRACT

A self-ventilating, enclosed, lighting device for dental, medical or the like uses having a frame of predetermined configuration with a light source mounted therein, a transparent shield mounted on and covering an open front thereof, and a light reflector mounted on the back and generally covering the open back. Inlet air passages are formed generally at the front of the device and exit air passages are formed generally at the back of the device. Airflow is created by convection heating of the air by the light source to cause an airflow into the lighting device through the inlet air passages, through the interior of the lighting device and around the light source, and out of the lighting device through the exit air passages for cooling the lighting device. The reflector is preferably pivotally mounted on the frame for being moved between an open position for access to the interior of the lighting device and a closed position during use of the lighting device. Handles are preferably connected to the frame by insulating means for insulating the heat generated in the lighting device from the handles to maintain the handles in a cool condition for touch by the user.

5 Claims, 9 Drawing Figures

SELF-VENTILATING DENTAL LIGHTING DEVICE

FIELD OF THE INVENTION

This invention relates to a self-ventilating, enclosed, lighting device for dental, medical or the like uses.

BACKGROUND OF THE INVENTION

In lighting devices of the type normally utilized in the dental, medical or the like fields in which a predetermined area of a patient is desired to be illuminated, problems have been presented with overheating of the interior of the lighting devices because of their enclosed constructions which shorten the life of the lighting source and can present problems with respect to explosions of the lighting source, etc.

While prior lighting devices have provided for self-ventilation, this self-ventilation has not been entirely satisfactory.

Another problem with lighting devices of this type is that such lighting devices normally include handles for manual manipulation of the lighting device by a user, i.e. dentist or dental assistant, etc. Such handles are usually constructed of the same material as the frame of the lighting device and such material is conventionally metal. Due to interior heating of the lighting device, these handles often became heated and uncomfortable to the touch of the user.

Another problem presented with such lighting devices is the interior cleaning thereof. It is desirable to clean the inside surface of the reflector as well as other areas of the interior of the lighting device and access must be had to the interior of the lighting device for purposes of replacing the light source, etc.

SUMMARY OF THE INVENTION

Accordingly, it is the object of the present invention to overcome the above-defined problems with lighting devices previously utilized in the dental, medical or the like field.

It has been found by this invention that such problems may be overcome by providing a self-ventilating, enclosed, lighting device for dental, medical or the like uses comprising, generally the following.

A frame of predetermined enclosed configuration is provided defining an open front and an open back for said lighting device. A transparent shield is mounted on the frame and generally covers the open front of the lighting device. A light reflector is mounted on the back of the frame and generally covers the open back of the frame. An interior chamber is formed within the lighting device and is defined by the frame, the shield and the reflector. A light source is mounted within the interior chamber for providing the desired illumination of the lighting device. Inlet air passage means are formed generally at the front of the lighting device and exit air passage means are formed generally at the back of the lighting device.

With this construction, airflow is created by convection heating of the air by the light source to cause an airflow into the lighting device through the inlet air passage means, through the interior of the lighting device and around the light source, and out of the lighting device through the exit air passage means for cooling of the lighting device.

Preferably, the inlet air passage means comprises an opening formed generally centrally of the transparent shield at the front of the frame and the exit air passage means comprises an opening or space between the outside periphery of the reflector and the frame so that air may flow into the lighting device at the front thereof, through the interior of the lighting device and out of the lighting device around substantially the entire periphery of the reflector for cooling the lighting device.

Handles are connected to the frame at generally the front thereof and include insulating means positioned between the handles and the frame for insulating the handles from the frame and the heat generated by the lighting device so as to maintain the handles in a relatively cool state for manual handling by a user of the lighting device.

Preferably, the lighting device further includes means pivotally mounting the reflector on the frame for being moved between a closed position when the lighting device is being operated and an open position when access to the interior of the lighting device is desired and for cleaning the inside surface of the reflector.

Accordingly, this invention has provided an improved self-ventilating, enclosed, lighting device which overcomes problems presented with prior lighting devices of this type.

BRIEF DESCRIPTION OF THE DRAWINGS

Some of the objects and advantages of the invention having been stated, other objects and advantages will appear when taken in conjunction with the accompanying drawings, in which.

DESCRIPTION OF ILLUSTRATED EMBODIMENT

Figure 1:
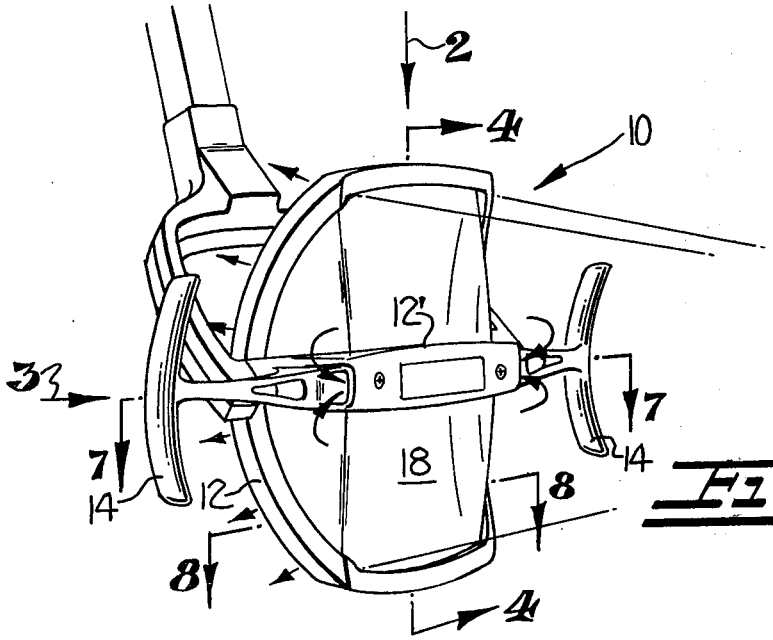
FIG. 1 is a perspective view of a self-ventilating dental or medical lighting device constructed in accordance with this invention and schematically illustrating the flow of air therethrough.
Figure 2:
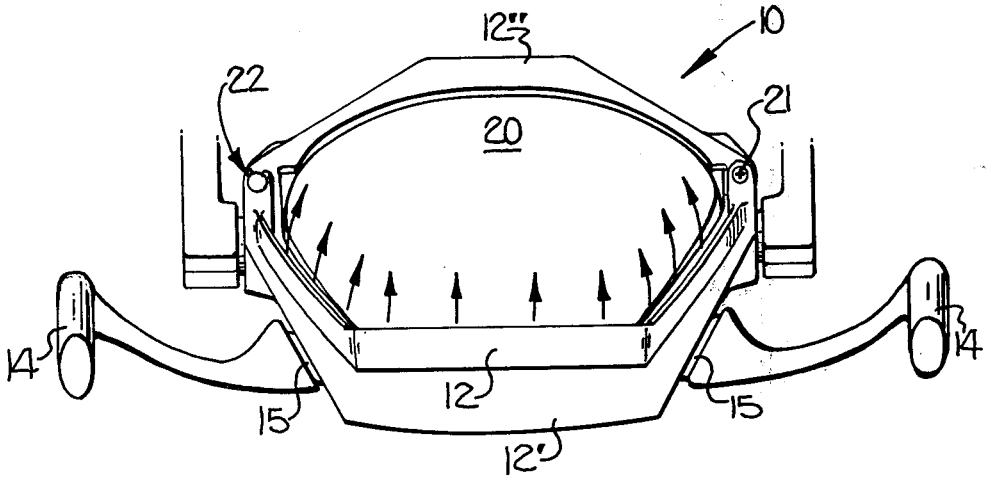
FIG. 2 is an end view of the lighting device of FIG. 1 and taken generally in the direction of the arrow 2 in FIG. 1.
Figure 3:
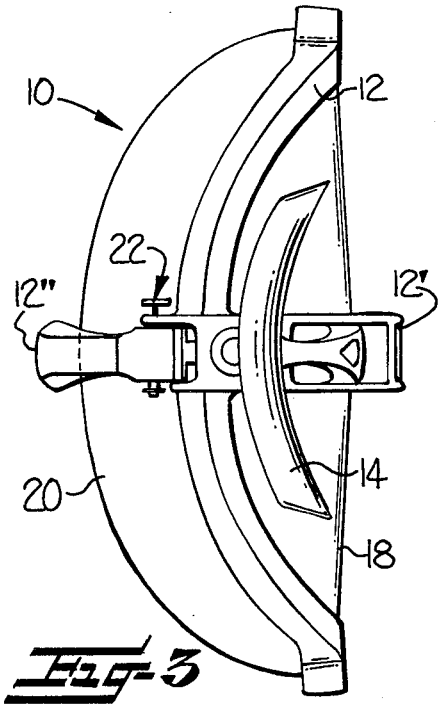
FIG. 3 is a side elevational view of the lighting device of FIG. 1 and taken generally in the direction of the arrow 3 of FIG. 1.

Referring now to the drawings, there is illustrated therein a lighting device, generally indicated by the reference numeral 10, which is applicable for dental, medical or like uses to illuminate a desired zone of a patient.

The lighting device 10 includes a frame 12 of predetermined configuration, as indicated in the drawings, which is somewhat dictated by the shape of the reflector, to be described below. The frame 12 is generally of enclosed curved-sided, rectangular configuration and defines an open front and an open back for the lighting device 10 and a portion 12' extending around and across the front from side to side for receiving and mounting handles 14.

Figure 7:
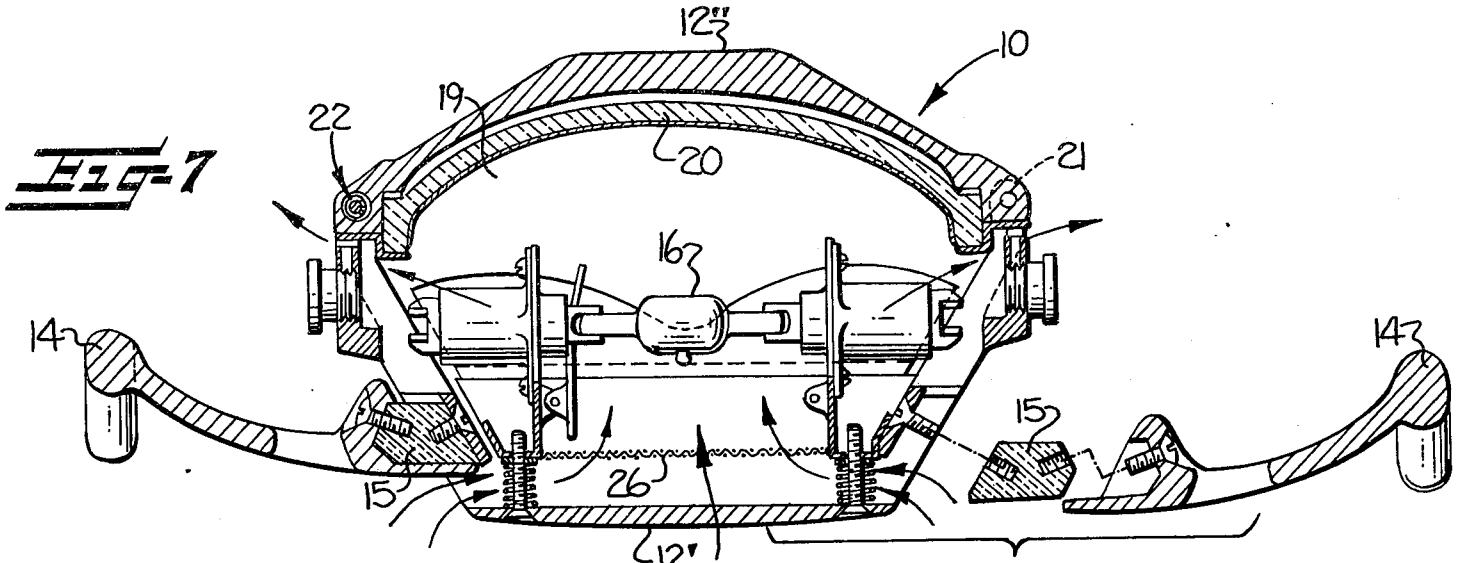
FIG. 7 is a sectional view through the lighting device of FIG. 1 and taken generally along the line 7—7 of FIG. 1.

The handles 14, as may be seen more clearly in FIG. 7, are mounted on the frame portion 12' by insulating blocks 15, which may be nylon, other suitable plastic or other insulating material. Normally, the frame 12 and handles 14 would be constructed of metal, which is conventional in lighting devices of this type, and the nylon blocks act as an insulating means for insulating the handles 14 from the frame 12 so as to prevent excessive heat generated in the lighting device 10 and heating the frame 12 to, in turn, overheat the handles 14.

The lighting device 10 further includes a light source 16 which may be any suitable electrically operated bulb and socket mechanism which is conventionally utilized in lighting devices of this type. The light source 16 is mounted within the frame 12 and, more particularly, within the frame portion 12' that extends around the open front thereof.

A transparent shield 18, which may be any suitable material such as LEXAN or otherwise, is mounted on the frame and generally covers the open front of the lighting device 10.

A light reflector 20 is mounted on the frame 12 and generally covers the open back of the lighting device 10. This reflector 20 may be of the type set forth in assignee's co-pending application Ser. No. 105,885, filed concurrently herewith. These reflectors are conventionally utilized for reflecting visible light from the light source 16 through the shield 18 in a predetermined pattern to illuminate a desired zone of a patient or otherwise.

The above described frame 12, shield 18 and reflector 20 together define an interior chamber 19 for receiving the light source 16.

Figure 5:
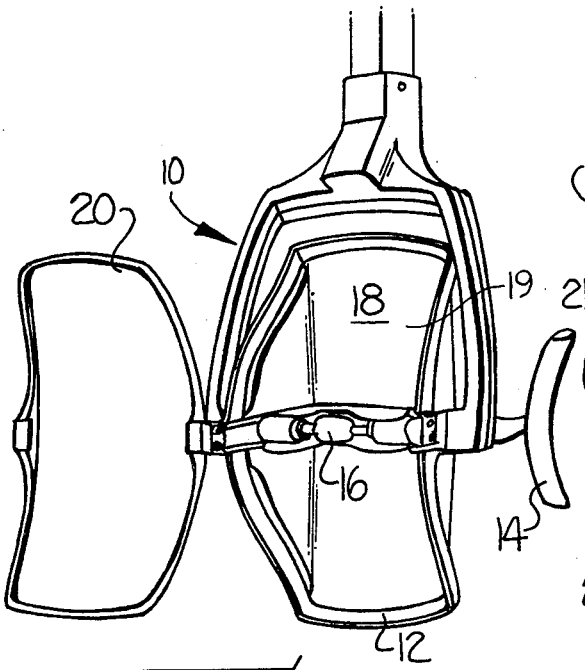
FIG. 5 is a perspective view from the rear of the lighting device of FIG. 1 and illustrating the pivotally mounted reflector in its open position.
Figure 6:
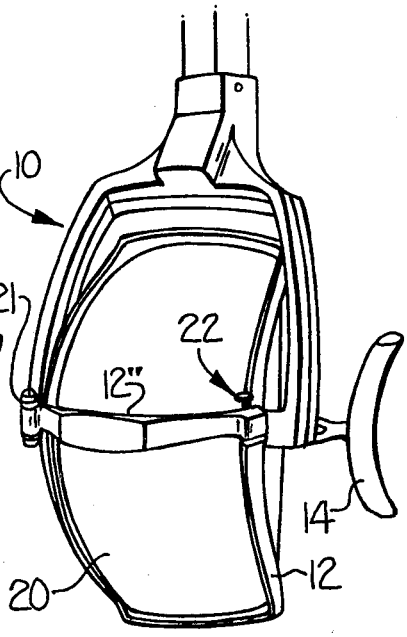
FIG. 6 is a perspective view from the rear of the lighting device of FIG. 1, like FIG. 5, and illustrating the pivotally mounted reflector in its closed position.
Figure 9:
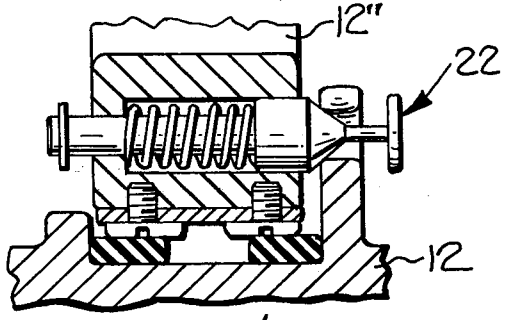
FIG. 9 is a sectional view taken through the locking device for the pivotally mounted reflector of the lighting device of this invention.
Figure 8:
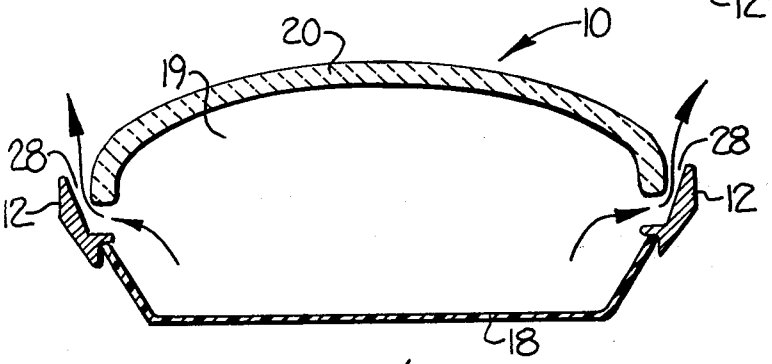
FIG. 8 is a sectional view through the lighting device of FIG. 1 and taken generally along the line 8—8 of FIG. 1.

In accordance with this invention, the light reflector 20 is pivotally mounted on frame portion 12'' which extends around and across the open back and is connected to frame 12 by a suitable hinge device 21 at one side thereof for being moved between a closed position, as shown in FIG. 6, when the lighting device 10 is being operated, and an open position, as illustrated in FIG. 5, when access to the interior of the lighting device is desired, such as for replacing the light source 16, and for cleaning the inside surface of the reflector 20 and the interior of the lighting device 10. A suitable lock device 22 is provided on the other side of the frame portion 12'' for holding the reflector 20 in its closed position. Structural details of a suitable locking device 22 are shown in FIG. 9.

Figure 4:
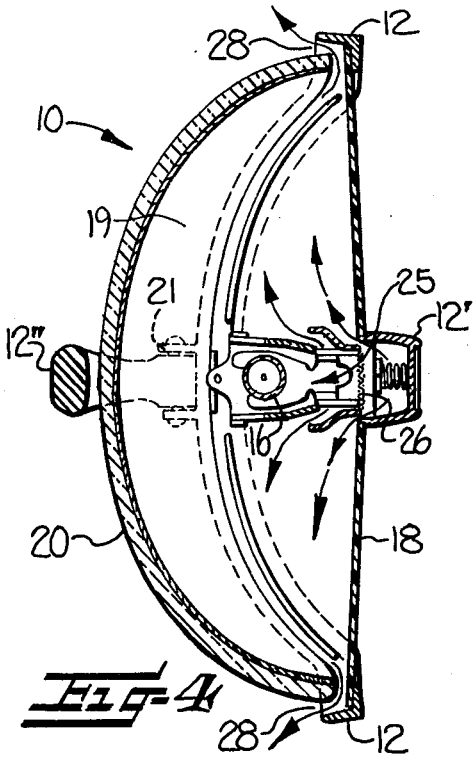
FIG. 4 is a sectional view through the lighting device of FIG. 1 and taken generally along the line 4—4 of FIG. 1.

For purposes of ventilating the lighting device 10, inlet air passage means are provided generally at the front of the lighting device 10 and comprise an opening, generally indicated at 25, see FIGS. 4 and 7 particularly, disposed generally centrally in the transparent shield 18 and under the frame portion 12' extending around the front of the lighting device 10. This frame portion 12', as shown particularly in FIGS. 4 and 7, includes openings on the sides thereof. The opening 25 into the interior of the lighting device 10 may be covered by a suitable perforated screen 26. Exit air passage means are formed generally at the back of the frame 12 and comprise an opening or space 28 between the outside periphery of the reflector 20 and the inside periphery of the enclosed frame 12. As may be seen in the drawings, the enclosed frame 12 may be analogized to a picture frame and comprises a generally L-shaped configuration in cross-section into which the outside periphery of the reflector 20 is received with the space 28 therebetween constituting the exit air passage means.

With this construction, airflow is created by convection heating of air by the light source 16 to cause air to flow into the lighting device 10 through the inlet air passage means 25, through the interior chamber 19 of the lighting device 10 and around the light source 16 and out of the lighting device 10 through the exit air passage means 28 for cooling of the lighting device 10, particularly the interior thereof and the light source 16. Such airflow is particularly effective when the lighting device 10 is oriented to direct its beam generally downwardly, which is its normal operating position.

Thus, this invention has provided an improved lighting device for medical, dental of the like uses, which overcomes the above-defined problems with prior lighting devices.

In the drawings and specification, there have been set forth preferred embodiments of the invention and although specific terms are employed, they are used in a generic and descriptive sense only and not for purposes of limitation.

What is claimed is:

1. A self-ventilating, enclosed lighting device for dental, medical or the like uses comprising:

a frame of predetermined enclosed configuration and defining an open front and an open back or said lighting device;

a transparent shield mounted on said frame and generally covering said open front of said lighting device;

a reflector mounted on said frame and generally covering said open back of said lighting device;

an interior chamber within said lighting device and defined by said frame, said shield and said reflector;

a light source mounted within said interior chamber and carried by said frame;

inlet air passage means formed generally at said front of said lighting device and disposed substantially centrally of said transparent shield; and exit air passage means formed generally at said back of said lighting device;

whereby, airflow is created by convection heating of the air by said light source to cause an airflow into said lighting device through said inlet air passage means, through said interior chamber and around said light source, and out of said lighting device through said exit air passage means for cooling said lighting device.

2. A self-ventilating, enclosed, lighting device, as set forth in claim 1, in which said exit air passage means comprises an opening formed between the outside periphery of said reflector and said frame providing exit air passage means substantially around the entire periphery of said reflector and said lighting device.

3. A self-ventilating, enclosed, lighting device, as set forth in claim 1, further including handles connected to said frame at generally said front and including insulating means between said handles and said frame for insulating said handles from the heat generated by said lighting device so as to maintain said handles in a relatively cool state for manual handling by a user of said lighting device.

4. A self-ventilating, enclosed, lighting device, as set forth in claim 1, further including means pivotally mounting said reflector on said frame for being moved between a closed position when said lighting device is being operated and an open position when access to the interior of said lighting device is desired and for cleaning the inside surface of said reflector.

5. A self-ventilating, enclosed, lighting device for dental, medical or the like uses comprising:

a frame of predetermined enclosed configuration and defining an open front and an open back for said lighting device;

a transparent shield mounted on said frame and generally covering said open front of said lighting device;

a light reflector mounted on said frame and generally covering said open back of said lighting device and including means pivotally mounting said reflector on said frame for being moved between a closed position when said lighting device is being operated and an open position when access to the interior of said lighting device is desired and for cleaning the inside surface of said reflector;

an interior chamber within said lighting device and defined by said frame, said shield and said reflector;

a light source mounted within said interior chamber and carried by said frame;

handles connected to said frame at generally the front thereof and including insulating means between said handles and said frame for insulating said handles from the heat generated by said lighting device so as to maintain said handles in a relatively cool state for manual handling by the user of said lighting device;

inlet air passage means formed generally at said front of said lighting device and comprising an opening disposed generally centrally in said transparent shield; and exit air passage means formed generally at said back of said lighting device and comprising an opening between the outside periphery of said reflector and said frame means;

whereby, airflow is created by convection heating of the air by said light source to cause an airflow into said lighting device through said inlet air passage means, through said interior chamber of said lighting device and around said light source and out of said lighting device through said exit air passage means for cooling said lighting device.

* * * * *